US010836970B2

(12) United States Patent
Berkhous et al.

(10) Patent No.: US 10,836,970 B2
(45) Date of Patent: Nov. 17, 2020

(54) LOW SULFUR MARINE FUEL COMPOSITIONS

(71) Applicant: ExxonMobil Research and Engineering Company, Annandale, NJ (US)

(72) Inventors: Scott K. Berkhous, Center Valley, PA (US); Erin R. Fruchey, Philadelphia, PA (US); Kenneth C. H. Kar, Philadelphia, PA (US); Sheryl B. Rubin-Pitel, Newtown, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 91 days.

(21) Appl. No.: 16/192,849

(22) Filed: Nov. 16, 2018

(65) Prior Publication Data

US 2019/0185772 A1 Jun. 20, 2019

Related U.S. Application Data

(60) Provisional application No. 62/607,354, filed on Dec. 19, 2017.

(51) Int. Cl.
*C10L 1/08* (2006.01)
*C10G 45/02* (2006.01)

(52) U.S. Cl.
CPC ..... *C10L 1/08* (2013.01); *C10G 45/02* (2013.01); *C10G 2400/04* (2013.01); *C10G 2400/06* (2013.01); *C10L 2200/0438* (2013.01); *C10L 2200/0446* (2013.01); *C10L 2270/026* (2013.01)

(58) Field of Classification Search
CPC ..... C10L 1/08; C10G 45/02
See application file for complete search history.

(56) References Cited

U.S. PATENT DOCUMENTS 3,522,169 A 7/1970 Ireland
4,601,303 A 7/1986 Jensen
4,677,567 A 6/1987 Grosser et al.
8,987,537 B1 * 3/2015 Droubi ..... C10L 1/08 585/14
9,057,035 B1 * 6/2015 Kraus ..... C10L 1/04
9,803,152 B2 * 10/2017 Kar ..... C10L 1/08
10,443,006 B1 * 10/2019 Fruchey ..... C10L 1/08
2012/0246999 A1 * 10/2012 Stern ..... C10G 45/02 44/300
2013/0014431 A1 * 1/2013 Jin ..... C10L 1/02 44/307
2013/0081978 A1 4/2013 Brown et al.
2014/0061094 A1 3/2014 Xu et al.
2014/0174980 A1 6/2014 Brown et al.
2016/0160139 A1 * 6/2016 Robinson ..... C10G 45/08 208/15
2017/0002273 A1 1/2017 Rubin-Pitel et al.
2018/0155647 A1 6/2018 Robinson et al.
2019/0016974 A1 * 1/2019 Moore ..... C10G 47/02

OTHER PUBLICATIONS

The International Search Report and Written Opinion of PCT/US2018/056241 dated Jan. 7, 2019.
Karonis et al., "A multivariate statistical analysis to evaluate and predict ignition quality of marine diesel fuel distillates from their physical properties", Fuel Processing Technology 166 (2017) 299-311.
Vermeire, "Everything you need to know about marine fuels", Retrieved from the internet: URL:https://www.chevronmarineproducts.com/content/dam/chevron-marine/Brochures/Chevron_EverythingYouNeeToKnowAboutFuels_v3_1a_Desktop.pdf [retrieved on Dec. 21, 2018].

* cited by examiner

*Primary Examiner* — Ellen M McAvoy
(74) *Attorney, Agent, or Firm* — Robert A. Migliorini

(57) ABSTRACT

Methods for making marine fuel oil compositions and/or marine gas oil compositions are provided. The fuel oil compositions can include a distillate fraction having a sulfur content of 0.40 wt % or more and a resid fraction having a sulfur content of 0.35 wt % or less. The distillate fraction can also have a suitable content of aromatics and/or suitable combined content of aromatics and naphthenes. The distillate fraction, optionally blended with a low sulfur distillate fraction, can be used as a gas oil fuel or fuel blending component. Using a distillate fraction with an elevated sulfur content and aromatics content as a blend component for forming a fuel oil can result in a marine fuel oil with improved compatibility for blending with other conventional marine fuel oil fractions.

26 Claims, No Drawings

LOW SULFUR MARINE FUEL COMPOSITIONS

CROSS-REFERENCE TO RELATED APPLICATIONS

This application claims priority to U.S. Provisional Application Ser. No. 62/607,354 filed Dec. 19, 2017 which is herein incorporated by reference in its entirety

FIELD

This invention relates generally to methods for making marine bunker fuels and/or marine distillate fuels having relatively low sulfur content, as well as to the resulting low sulfur content fuel compositions made according to such methods.

BACKGROUND

As promulgated by the International Maritime Organization (IMO), issued as Revised MARPOL Annex VI, marine fuels will be capped globally with increasingly more stringent requirements on sulfur content. In addition, individual countries and regions are beginning to restrict sulfur level used in ships in regions known as Emission Control Areas, or ECAs.

Those regulations specify, inter alia, a 1.0 wt % sulfur content on ECA Fuels (effective July 2010) for residual or distillate fuels, a 3.5 wt % sulfur content cap (effective January 2012), which can impact about 15% of the current residual fuel supply, a 0.1 wt % sulfur content on ECA Fuels (effective January 2015), relating mainly to hydrotreated middle distillate fuel, and a 0.5 wt % sulfur content cap (circa 2020-2025), centered mainly on distillate fuel or distillate/residual fuel mixtures. It is noted that this latter 0.5 wt % sulfur content cap corresponds to a global regulation that can potentially affect all non-ECA fuels unless an alternative mitigation method is in place, such as an on-board scrubber. When the ECA sulfur limits and sulfur cap drops, various reactions may take place to supply low sulfur fuels.

The fuels used for larger ships in global shipping are typically marine bunker fuels. Bunker fuels are advantageous since they are less costly than other fuels; however, they are typically composed of cracked and/or resid fuels and hence have higher sulfur levels. Such cracked and/or resid fuels are typically not hydrotreated or only minimally hydrotreated prior to incorporation into the bunker fuel. Instead of attempting to hydrotreat the cracked and/or resid fuels to meet a desired sulfur specification, the lower sulfur specifications for marine vessels can be conventionally accomplished by blending the cracked and/or resid fuels with distillates. While blending with distillate fuels can be effective for reducing sulfur levels, such low sulfur distillate fuels typically trade at a high cost premium for a variety of reasons, not the least of which is the utility in a variety of transport applications employing compression ignition engines. Conventionally, distillate fuels are produced at low sulfur levels, typically significantly below the sulfur levels specified in the IMO regulations.

In addition to distillate fuels having a higher value in uses other than bunker fuels, blending distillate fuels with other fractions to form a marine fuel can potentially cause difficulties due to incompatibility. Many residual or heavy fractions that are used as blending components to form bunker fuels can include various multi-ring structures, including multi-ring structures that correspond to asphaltenes based on the definition of n-heptane asphaltenes under ASTM D3279. Such residual or heavy oil fractions may not be fully compatible when blended with distillate fractions, resulting in a fuel blend that may form precipitated solids under certain conditions. Such solid compounds can potentially cause flow problems within a fuel delivery system.

It would be advantageous to develop marine fuels, and corresponding methods of forming marine fuels, that had increased compatibility when additional distillate blend stocks are added to the marine fuels.

SUMMARY

In various aspects, a method for forming a fuel oil composition is provided. The method can include blending a first distillate fraction with a resid fraction to form the fuel oil composition. The first distillate fraction can have a T90 distillation point of 400° C. or less and/or a sulfur content of 0.40 wt % or more and/or an aromatics content of greater than 35 wt % relative to a weight of the first distillate fraction. The resid fraction can have a T90 distillation point of 500° C. or more and/or a sulfur content of 0.35 wt % or less relative to a weight of the resid fraction. The resulting fuel oil composition can have a sulfur content of 0.1 wt % to 0.6 wt % relative to a weight of the fuel oil composition. The fuel oil composition can include at least 5 wt % of the first distillate fraction and/or at least 15 wt % of the resid fraction. Optionally, the first distillate fraction can correspond to a hydrotreated distillate fraction and/or the resid fraction can correspond to a hydrotreated resid fraction.

In some aspects, the fuel oil composition can have a BMCI of 40.0 or more and/or a kinematic viscosity at 50° C. of at least 5 cSt, or at least 15 cSt. In some aspects, the fuel oil composition can include at least 25 wt % of the resid fraction, or at least 45 wt %.

In some aspects, the first distillate fraction can have a T50 distillation point of 300° C. or more. In some aspects, the resid fraction can have a T50 distillation point of 340° C. or more.

Optionally, the blending can further include blending a second hydrotreated distillate fraction having a sulfur content of 0.1 wt % or less with the first distillate fraction, the resid fraction, or the fuel oil composition. An amount of the second hydrotreated distillate fraction in the fuel oil composition can correspond to less than half the amount of the first distillate fraction in the fuel oil composition.

In various aspects, a method for forming a gas oil composition is also provided. The method can include blending a first distillate fraction with a second distillate fraction to form a gas oil composition. The first distillate fraction can have a T90 distillation point of 400° C. or less and/or a sulfur content of 0.40 wt % or more and/or an aromatics content of greater than 35 wt % relative to a weight of the first distillate fraction. The second distillate fraction can have a sulfur content of 0.1 wt % or less relative to a weight of the second distillate fraction. The gas oil composition can have a sulfur content of 0.1 wt % to 0.6 wt % relative to a weight of the gas oil composition. The gas oil composition can include at least 10 wt % of the first distillate fraction and at least 10 wt % of the second distillate fraction. Optionally, the first distillate fraction can correspond to a hydrotreated distillate fraction and/or the second distillate fraction can correspond to a hydrotreated distillate fraction. Optionally, the gas oil composition can have a flash point of 60° C. or more and/or the second distillate fraction can have a flash point of less than 60° C. Optionally, the gas oil composition can have a kinematic viscosity at 40° C. of 2.5 cSt or more and/or a cetane index of 50.0 or more.

In some aspects, the first distillate fraction can have a T50 distillation point of 300° C. or more. In some aspects, the second distillate fraction can have a T50 distillation point of 280° C. or less.

In various aspects, the first distillate fraction can optionally include a combined content of aromatics and naphthenes of 60 wt % or more and/or 38 wt % or more aromatics. Optionally, the first distillate fraction can be formed by hydrotreating a feed including a distillate portion to form an effluent comprising the first distillate fraction. Optionally, the feed and/or the distillate portion of the feed can include an aromatics content of 50 wt % or more.

In various aspects, a distillate composition is also provided. The composition can have a T90 distillation point of 400° C. or less, a T50 distillation point of 300° C. or more, a cetane index of 50 or more, a sulfur content of 0.40 wt % or more, an aromatics content of greater than 35 wt %, and a combined content of aromatics and naphthenes of 60 wt % or more relative to a weight of the composition. The composition can optionally include a flash point of 100° C. or more and/or a cloud point of 0° C. or less.

DETAILED DESCRIPTION

All numerical values within the detailed description and the claims herein are modified by "about" or "approximately" the indicated value, and take into account experimental error and variations that would be expected by a person having ordinary skill in the art.

In various aspects, marine fuel oil compositions are provided that have sulfur contents of 0.6 wt % or less, for example 0.1 wt % to 0.5 wt % or 0.2 wt % to 0.5 wt %, while having improved compatibility for blending with other marine fuel oil fractions. In various aspects, methods of making such marine fuel oil compositions are also provided. The marine fuel oil compositions can be made in part by blending a resid fraction with a sulfur content of ~0.35 wt % or less with a distillate fraction having a sulfur content of at least 0.40 wt %, or at least 0.45 wt %, or at least 0.50 wt %. The distillate fraction can also have a suitable content of aromatics and/or suitable combined content of aromatics and naphthenes. In some aspects, the distillate fraction can correspond to a hydrotreated distillate fraction where the hydrotreating is performed under lower severity conditions that result in retention of a higher percentage of aromatics in the hydrotreated distillate fraction. Using a distillate fraction with an elevated sulfur content and aromatics content as a blend component for forming a fuel oil can result in a marine fuel oil with improved compatibility for blending with other conventional marine fuel oil fractions. Optionally, one or more additional hydrotreated or non-hydrotreated resid or cracked fractions can also be included in the blend to form the marine fuel oil composition. Optionally, one or more additional hydrotreated distillate fractions can be included in the blend to form the marine fuel oil composition. Optionally, one or more hydrotreated or non-hydrotreated biofuel fractions can be included in the marine fuel oil composition. Optionally, one or more additives can be included in the blend to form the marine fuel oil composition.

In various aspects, marine distillate fuel compositions are also provided, where the marine distillate fuel compositions have sulfur contents of 0.6 wt % or less, such as 0.1 wt % to 0.5 wt %. In other aspects, the marine distillate fuel compositions can be made in part by blending a first distillate fraction having a low sulfur content with a second distillate fraction having a sulfur content of 0.40 wt % or more, or 0.45 wt % or more, or 0.50 wt % or more, and a suitable content of aromatic compounds and/or combined contents of naphthenic and aromatic compounds. Use of the second distillate fraction as a blend component can have a variety of advantages. Due to the higher sulfur content, the second distillate fraction can potentially provide a cost advantage when attempting to form a marine distillate fuel based on, for example, a reduced or minimized amount of hydrotreating or other processing used to form the second distillate fraction. Additionally or alternately, the second distillate fraction can have a higher flash point and/or density and/or viscosity, which can allow the overall marine distillate fuel to meet expected specifications or target values in situations where the first fraction (or fractions) may be outside of such specifications.

In still other aspects, a marine distillate fuel composition is provided corresponding to a hydrotreated distillate fraction having a sulfur content of 0.40 wt % or more, or 0.45 wt % or more, or 0.50 wt % or more and a suitable content of aromatic compounds and/or combined contents of naphthenic and aromatic compounds.

Conventionally, marine fuel oils are formed at least in part by using residual fractions. Due to the high sulfur content of many types of residual fractions, some type of additional processing and/or blending is often required to form low sulfur fuel oils (0.5 wt % or less sulfur) or ultra low sulfur fuel oils (0.1 wt % or less sulfur). Conventionally, blending with one or more low sulfur distillate fractions (such as hydrotreated distillate fractions) is typically used to adjust the sulfur content of the resulting blended fuel. Typical distillate blending components can correspond to, for example, fractions suitable for inclusion in an ultra low sulfur diesel pool. In addition to reducing the sulfur content of the resulting blended fuel, blending in a distillate fraction can also modify the viscosity, density, combustion quality (CCAI), pour point, and/or other properties of the fuel. Because having lower pour point and/or viscosity is often beneficial for improving the grade of the marine fuel oil, blending can often be preferable to performing severe hydrotreating on a resid fraction in order to meet a target sulfur level of 0.5 wt % or less.

Although conventional strategies for blending hydrotreated distillate fractions with resid fractions can be useful for achieving a desired fuel oil sulfur target, blending with sufficient distillate to produce a low sulfur fuel oil can potentially cause difficulties for compatibility. Due to the severe hydrotreating needed to produce distillate fuel with 500 wppm or less of sulfur, or 100 wppm or less of sulfur, typical low sulfur distillate blendstocks can have relatively low aromatic contents, such as aromatic contents of ~35 wt % or less, along with a limited content of multi-ring naphthenes and/or aromatics. By contrast, typical resid (or hydrotreated resid) fractions can tend to have relatively large concentrations of multi-ring aromatics, including some asphaltenes. This can create two types of compatibility issues. A first compatibility issue can arise when blending to form a marine fuel oil, where the low aromatic character of a conventional low sulfur distillate fraction may lead to precipitation of asphaltenes. A second compatibility issue can arise in use. When refilling a fuel tank, the nature of the prior marine fuel oil may not be known. If the prior fuel oil is not fully compatible with the new fuel oil, precipitation may occur within the fuel system of a ship. Similar blending difficulties can also arise, for example, on a bunker barge for delivering fuel to ships. This can result in solids that can clog the fuel filters in a marine fuel oil delivery system.

In various aspects, one or more difficulties that result from incorporation of conventional hydrotreated distillates into marine fuel oils can be unexpectedly overcome by using a different strategy for forming a marine fuel oil. Instead of relying on the distillate fraction to correct the sulfur level of the fuel oil, a distillate can be used that has been exposed to lower severity hydrotreating conditions and/or other lower severity processing conditions, so that the resulting distillate from the lower severity processing has a sulfur content of 0.40 wt % or more, or 0.45 wt % or more, or 0.50 wt % or more, such as up to 0.80 wt % or possibly still higher. A distillate fraction that is less severely processed, as evidenced by a higher sulfur content, can also correspond to a distillate fraction with an increased content of aromatics relative to the expected amount of aromatics for a distillate fraction with a sulfur content of 1000 wppm or less, or 500 wppm or less, or 100 wppm or less. The increased amount of aromatics in a distillate fraction with a sulfur content of 0.40 wt % or more, or 0.45 wt % or more, or 0.50 wt % or more, can provide improved solubility characteristics for the resulting marine fuel oil.

In some aspects, the distillate fraction having a sulfur content of 0.40 wt % or more, or 0.45 wt % or more, or 0.50 wt % or more, can also have a desirable content of aromatics and/or compounds containing at least one ring (i.e., naphthenes plus aromatics). For example, the distillate fraction can have an aromatics content of greater than 35 wt %, or 38 wt % or more, or 40 wt % or more, such as up to 60 wt % or possibly still higher. Additionally or alternately, the distillate fraction can have a combined naphthenes plus aromatics content of 60 wt % or more, or 65 wt % or more, or 70 wt % or more, such as up to 85 wt % or possibly still higher. Additionally or alternately, the distillate fraction can have a combined multi-ring naphthenes and multi-ring aromatics content of 25 wt % or more, or 30 wt % or more, or 35 wt % or more, or 40 wt % or more, such as up to 60 wt % or possibly still higher. It is noted that a naphthenoaromatic compound can be counted as either a naphthene or an aromatic, but should not be double counted when determining a combined naphthenes and aromatics content. It is noted that hydrotreatment typically results primarily in saturation of aromatic ring structures, as opposed to ring opening. Therefore, for hydrotreated distillate fractions, the combined naphthenes and aromatics content (total or multi-ring) of the distillate fraction prior to hydrotreatment can be similar to the combined content after hydrotreatment.

In some aspects, the distillate fraction having a sulfur content of 0.40 wt % or more, or 0.45 wt % or more, or 0.50 wt % or more, can also have a higher density and/or higher boiling range than a conventional full boiling range diesel fuel. For example, the distillate fraction can have a T10 distillation point (according to ASTM D2887) of 240° C. or more, or 260° C. or more, or 280° C. or more, such as up to 320° C. or possibly still higher. Additionally or alternately, the distillate fraction can have a T50 distillation point (according to ASTM D2887) of 300° C. or more, or 315° C. or more, or 325° C. or more, such as up to 340° C. or possibly still higher. Additionally or alternately, the distillate fraction can have a T90 distillation point of 400° C. or less, or 380° C. or less, or 370° C. or less. With regard to density, the distillate fraction having a sulfur content of 0.40 wt % or more can have a density of 0.86 g/cm$^3$ at 15° C. or more, or 0.865 g/cm$^3$ or more, such as up to 0.88 g/cm$^3$.

In various aspects, the distillate fraction including a sulfur content of 0.4 wt % or more can be blended with a lower sulfur content resid fraction, such as a hydrotreated resid fraction that has a sulfur content of 0.35 wt % or less, or 0.30 wt % or less. For example, a hydrotreated resid fraction can be used with a sulfur content 0.10 wt % to 0.35 wt %, or 0.20 wt % to 0.35 wt %, or 0.10 wt % to 0.30 wt %. This type of (optionally hydrotreated) resid fraction can benefit from blending with a distillate fraction to modify the kinematic viscosity, the CCAI (calculated carbon aromaticity index), the pour point and/or other properties. In particular, blending of minor portions of a distillate fraction with a resid fraction can result in substantial improvements in properties such as pour point for the resulting marine fuel oil relative to the properties of the resid fraction. In some aspects, the (optionally hydrotreated) resid fraction can have an asphaltenes content (according to ASTM D6560) of 0.2 wt % or more, or 0.4 wt % or more, or 0.6 wt % or more, or 0.8 wt % or more, such as up to 2.0 wt % or possibly still higher. In some aspects, the (optionally hydrotreated) resid can have a pour point of 15° C. or more, or 20° C. or more, or 25° C. or more, such as up to 40° C. or possibly still higher. In some aspects, the (optionally hydrotreated) resid can have a kinematic viscosity (ISO 3104) at 50° C. of 100 cSt or more, or 300 cSt or more, or 500 cSt or more, such as up to 1000 cSt or possibly still higher. Additionally or alternately, the (optionally hydrotreated) resid can have a kinematic viscosity at 100° C. of 20 cSt or more, or 25 cSt or more, or 30 cSt or more, such as up to 125 cSt or possibly still higher. In some aspects, the (optionally hydrotreated) resid can have a density at 15° C. of 0.91 g/cm$^3$ to 0.97 g/cm$^3$, or 0.92 g/cm$^3$ to 0.96 g/cm$^3$. Additionally or alternately, the (optionally hydrotreated) resid can have an initial boiling point of 300° C. or more, or 320° C. or more, or 330° C. or more, such as up to 385° C. or possibly still higher.

After blending, a marine fuel oil or fuel oil blend component can have a sulfur content of 0.60 wt % or less, for example 0.10 wt % to 0.60 wt %, or 0.20 wt % to 0.60 wt %, or 0.10 wt % to 0.50 wt %, or 0.20 wt % to 0.50 wt %. Any convenient amount of (optionally hydrotreated) distillate having a sulfur content of at least 0.40 wt %, or at least 0.45 wt %, or at least 0.50 wt % and resid having a sulfur content of 0.35 wt % or less may be included in a blend to form the marine fuel oil. In some aspects, the amount of distillate having a sulfur content of 0.40 wt % or more, or 0.45 wt % or more, or 0.50 wt % or more, in the marine fuel oil (or marine fuel oil blending component) can be 5 wt % to 80 wt % of the weight of the marine fuel oil, or 10 wt % to 80 wt %, or 25 wt % to 80 wt %, or 5 wt % to 60 wt %, or 10 wt % to 60 wt %, or 25 wt % to 60 wt %. In some aspects, the amount of resid having a sulfur content of less than 0.35 wt %, or less than 0.30 wt %, in the marine fuel oil can be 15 wt % to 95 wt % of the weight of the marine fuel oil, or 20 wt % to 90 wt %, or 20 wt % to 75 wt %, or 40 wt % to 95 wt %, or 40 wt % to 90 wt %, or 40 wt % to 75 wt %.

Optionally, other fractions can be included in the blend besides the low sulfur resid fraction and the higher sulfur distillate fraction. For example, in some aspects the blend can further include a hydrotreated distillate fraction having a sulfur content of 1000 wppm or less, or 100 wppm or less. In such aspects, the amount of the hydrotreated distillate fraction having a sulfur content of 1000 wppm or less (or 100 wppm or less) can be less than 50% of the amount of the higher sulfur distillate fraction (i.e., the fraction having a sulfur content of 0.40 wt % or more), or less than 30% of the amount, or less than 15% of the amount. Additionally or alternately, the amount of the hydrotreated distillate fraction having a sulfur content of 1000 wppm or less (or 100 wppm or less) can correspond to 15 wt % or less of the blend, or 10 wt % or less, or 5 wt % or less.

As another example, in some aspects the blend can further include a resid and/or cracked fraction having a sulfur content of greater than 0.5 wt %. Such a fraction can correspond to a resid and/or cracked fraction that would be conventionally used for forming a fuel oil.

One option for characterizing the improved compatibility of a marine fuel oil (or marine fuel oil blend component) formed using a distillate fraction having a sulfur content of at 0.40 wt % or more, or 0.45 wt % or more, or 0.50 wt % or more, can be based on the Bureau of Mines Correlation Index (BMCI) for the fuel oil. The BMCI of a fuel oil can be 40.0 or more, or 42.0 or more, or 45.0 or more. In this discussion, BMCI values can be calculated based on density and kinematic viscosity at 50° C.

Other properties of the marine fuel oil that can be characterized include, but are not limited to, flash point (according to ISO 2719 A), pour point (ISO 3016), kinematic viscosity (ISO 3104), and boiling range (D7169). For example, the flash point of the marine fuel oil can be 80° C. or more, or 100° C. or more, or 120° C. or more, such as up to 200° C. or possibly still higher. Additionally or alternately, the pour point can be 10° C. or less, or 5° C. or less, or 0° C. or less, such as down to −20° C. or possibly still lower. Additionally or alternately, the kinematic viscosity at 50° C. can be 5 cSt to 300 cSt, or 5 cSt to 150 cSt, or 15 cSt to 300 cSt, or 15 cSt to 150 cSt, or 25 cSt to 300 cSt, or 25 cSt to 150 cSt. For example, the kinematic viscosity at 50° C. can be at least 5 cSt, or at least 15 cSt. It is noted that fuel oils with a kinematic viscosity at 50° C. of 15 cSt or higher can be beneficial, as such fuel oils typically do not require any cooling prior to use in order to be compatible with a marine engine. Additionally or alternately, the boiling range for the marine fuel oil can include a T50 distillation point of 320° C. or more, or 340° C. or more, or 360° C. or more, such as up to 550° C. or possibly still higher. Additionally or alternately, the boiling range for the marine fuel oil can include a T90 distillation point of 500° C. or more, or 550° C. or more, or 600° C. or more, such as up to 750° C. or possibly still higher. Additionally or alternately, the micro carbon residue of the marine fuel oil can be 5.0 wt % or less, or 4.0 wt % or less, such as down to 0.5 wt % or possibly still lower, as determined according to ISO 10370.

In addition to forming marine fuel oils and/or marine fuel oil blending components, distillate fractions having a sulfur content of 0.40 wt % or more can also be useful for forming marine distillate fuels. Such an optionally hydrotreated distillate fraction having a sulfur content of 0.40 wt % or more, or 0.45 wt % or more, or 0.50 wt % or more, can be combined with one or more other (optionally hydrotreated) distillate fractions. In some aspects, a distillate fraction having a sulfur content of 0.40 wt % or more, can also have a higher boiling range than a conventional hydrotreated distillate fraction; a higher flash point than a conventional hydrotreated distillate fraction; and/or a higher cetane index than a conventional hydrotreated distillate fraction. This can allow a distillate fraction having a sulfur content of 0.40 wt % or more to be used as a blending component for improving the properties of a marine distillate fuel blend, with such improvement possibly allowing the marine distillate fuel blend to satisfy one or more specifications that are not satisfied by the conventional distillate fraction(s).

In some aspects, a distillate fraction having a sulfur content of 0.40 wt % or more, or 0.45 wt % or more, or 0.50 wt % or more, can have a cetane index (D4737-A) of 52.0 or more, or 54.0 or more, or 56.0 or more, such as up to 66.0 or possibly still higher. Additionally or alternately, such a distillate fraction can have a flash point of 80° C. or more, or 100° C. or more, or 120° C. or more, such as up to 140° C. or possibly still higher. Additionally or alternately, such a distillate fraction can have a T10 distillation point (ASTM D2887) of 240° C. or more, or 260° C. or more, or 280° C. or more, such as up to 320° C. or possibly still higher. Additionally or alternately, such a distillate fraction can have a T50 distillation point of 280° C. or more, or 300° C. or more, or 315° C. or more, such as up to 340° C. or possibly still higher. Additionally or alternately, such a distillate fraction can have a T90 distillation point of 400° C. or less, or 375° C. or less, or 350° C. or less, such as down to 325° C. or possibly still lower.

The resulting marine distillate fuel/marine gas oil formed by blending a low sulfur distillate fraction (or fractions) with a distillate fraction having a sulfur content of 0.40 wt % or more can have a flash point of 60° C. or more, or 70° C. or more, or 80° C. or more, such as up to 130° C. or possibly still higher. Additionally or alternately, the marine distillate fuel can have a cetane index of 50.0 or more, or 52.0 or more, or 54.0 or more, such as up to 60.0 or possibly still higher. Additionally or alternately, the marine distillate fuel can have a density at 15° C. of 830 kg/m$^3$ or more, or 840 kg/m$^3$ or more, or 850 kg/m$^3$ or more, such as up to 870 kg/m$^3$ or possibly still higher. Additionally or alternately, the marine distillate fuel can have a pour point (ISO 3016) of 0° C. or less, or −5° C. or less, or −10° C. or less, such as down to −20° C. or possibly still lower. Additionally or alternately, the marine distillate fuel can have a T90 distillation point of 400° C. or less, or 375° C. or less, or 350° C. or less, such as down to 325° C. or possibly still lower. Additionally or alternately, the marine distillate fuel can have a T50 distillation point of 350° C. or less, or 330° C. or less, or 315° C. or less, such as down to 280° C. or possibly still lower. Additionally or alternately, the marine distillate fuel can have a kinematic viscosity at 40° C. of 2.5 cSt or more, or 4.0 cSt or more.

It is noted that in some aspects, a distillate fraction with a sulfur content of 0.35 wt % or more, or 0.40 wt % or more, or 0.45 wt % or more, or 0.50 wt % or more, may be suitable for use as a marine distillate fuel and/or marine distillate fuel blending component without further blending with another distillate fraction. Such a distillate fraction can have properties similar to those described above for the marine distillate blends that include a distillate fraction having a sulfur content of 0.40 wt % or more.

A marine fuel oil composition as described herein, including a blend of a) (optionally hydrotreated) distillate having a sulfur content of 0.40 wt % or more, or 0.45 wt % or more, or 0.50 wt % or more, and b) a lower sulfur content resid, may be used a blendstock for forming marine fuel oils including 0.1 wt % or less of sulfur, or 0.5 wt % or less of sulfur, or 0.1 wt % to 0.5 wt % of sulfur. Where it is used as a blendstock, it may be blended with any of the following and any combination thereof to make an on-spec <0.1 wt % or <0.5 wt % sulfur finished fuel: low sulfur diesel (sulfur content of less than 500 ppmw), ultra low sulfur diesel (sulfur content <10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated natural fats or oils such as tall oil or vegetable oil, fatty acid methyl esters, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gasoil, non-hydrotreated coker vacuum gas oil, non-hydrotreated thermally cracked vacuum gas oil, non-hydrotreated thermally cracked diesel, non-hydrotreated thermally cracked gas oil, Group 1 slack waxes, lube oil aromatic extracts, deasphalted oil, atmospheric tower bottoms, vacuum tower bottoms, steam cracker tar, any residue materials derived from low sulfur crude slates, LSFO, RSFO, other LSFO/RSFO blendstocks. LSFO refers to low sulfur fuel oil, while RSFO refers to regular sulfur fuel oil.

A marine distillate fuel composition as described herein (also referred to as a marine gas oil composition), including a distillate having a sulfur content of 0.40 wt % or more, or 0.45 wt % or more, or 0.50 wt % or more, and optionally including a second distillate fraction having a lower sulfur content, may be used a blendstock for forming marine distillate fuels including 0.1 wt % or less of sulfur, or 0.5 wt % or less of sulfur, or 0.1 wt % to 0.5 wt % of sulfur. Where it is used as a blendstock, it may be blended with any of the following and any combination thereof to make an on-spec <0.1 wt % or <0.5 wt % sulfur finished marine gas oil: low sulfur diesel (sulfur content of less than 500 ppmw), ultra low sulfur diesel (sulfur content <10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated natural fats or oils such as tall oil or vegetable oil, fatty acid methyl esters, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gasoil, non-hydrotreated coker vacuum gas oil, non-hydrotreated thermally cracked vacuum gas oil, non-hydrotreated thermally cracked diesel, non-hydrotreated thermally cracked gas oil, Group 1 slack waxes, lube oil aromatic extracts, deasphalted oil, atmospheric tower bottoms, vacuum tower bottoms, steam cracker tar, any residue materials derived from low sulfur crude slates, LSFO, RSFO, other LSFO/RSFO blendstocks.

Other Components of the Composition

When there are other components in a marine fuel oil composition or a marine distillate fuel composition, there can be up to 70 vol % of other components, individually or in total, for example up to 65 vol %, up to 60 vol %, up to 55 vol %, up to 50 vol %, up to 45 vol %, up to 40 vol %, up to 35 vol %, up to 30 vol %, up to 25 vol %, up to 20 vol %, up to 15 vol %, up to 10 vol %, up to 7.5 vol %, up to 5 vol %, up to 3 vol %, up to 2 vol %, up to 1 vol %, up to 0.8 vol %, up to 0.5 vol %, up to 0.3 vol %, up to 0.2 vol %, up to 1000 vppm, up to 750 vppm, up to 500 vppm, up to 300 vppm, or up to 100 vppm.

Additionally or alternatively, when there are other components in a marine fuel oil composition or a marine distillate fuel composition, there can be at least about 100 vppm of other components, individually or in total, for example at least about 300 vppm, at least about 500 vppm, at least about 750 vppm, at least about 1000 vppm, at least about 0.2 vol %, at least about 0.3 vol %, at least about 0.5 vol %, at least about 0.8 vol %, at least about 1 vol %, at least about 2 vol %, at least about 3 vol %, at least about 5 vol %, at least about 7.5 vol %, at least about 10 vol %, at least about 15 vol %, at least about 20 vol %, at least about 25 vol %, at least about 30 vol %, at least about 35 vol %, at least about 40 vol %, at least about 45 vol %, at least about 50 vol %, at least about 55 vol %, at least about 60 vol %, or at least about 65 vol %. Examples of such other components can include, but are not limited to, viscosity modifiers, pour point depressants, lubricity modifiers, antioxidants, and combinations thereof. Other examples of such other components can include, but are not limited to, distillate boiling range components such as straight-run atmospheric (fractionated) distillate streams, straight-run vacuum (fractionated) distillate streams, hydrocracked distillate streams, and the like, and combinations thereof. Such distillate boiling range components can behave as viscosity modifiers, as pour point depressants, as lubricity modifiers, as some combination thereof, or even in some other functional capacity in the aforementioned low sulfur marine bunker fuel.

Examples of pour point depressants can include, but are not limited to, oligomers/copolymers of ethylene and one or more comonomers (such as those commercially available from Infineum, e.g., of Linden, N.J.), which may optionally be modified post-polymerization to be at least partially functionalized (e.g., to exhibit oxygen-containing and/or nitrogen-containing functional groups not native to each respective comonomer). Depending upon the physicochemical nature of the marine fuel oil or marine distillate fuel, in some embodiments, the oligomers/copolymers can have a number average molecular weight ($M_n$) of about 500 g/mol or greater, for example about 750 g/mol or greater, about 1000 g/mol or greater, about 1500 g/mol or greater, about 2000 g/mol or greater, about 2500 g/mol or greater, about 3000 g/mol or greater, about 4000 g/mol or greater, about 5000 g/mol or greater, about 7500 g/mol or greater, or about 10000 g/mol or greater. Additionally or alternately in such embodiments, the oligomers/copolymers can have an $M_n$ of about 25000 g/mol or less, for example about 20000 g/mol or less, about 15000 g/mol or less, about 10000 g/mol or less, about 7500 g/mol or less, about 5000 g/mol or less, about 4000 g/mol or less, about 3000 g/mol or less, about 2500 g/mol or less, about 2000 g/mol or less, about 1500 g/mol or less, or about 1000 g/mol or less. The amount of pour point depressants, when desired, can include any amount effective to reduce the pour point to a desired level, such as within the general ranges described hereinabove.

In some embodiments, a marine fuel oil composition or marine distillate fuel composition can comprise up to 15 vol % (for example, up to 10 vol %, up to 7.5 vol %, or up to 5 vol %; additionally or alternately, at least about 1 vol %, for example at least about 3 vol %, at least about 5 vol %, at least about 7.5 vol %, or at least about 10 vol %) of slurry oil, fractionated (but otherwise untreated) crude oil, or a combination thereof.

In some embodiments, up to about 50 vol % of a marine fuel oil composition or marine distillate fuel composition can be diesel additives. These diesel additives can be cracked or uncracked, or can be a blend of cracked and uncracked diesel fuels. In particular embodiments, the diesel additives can include a first diesel additive and a second diesel additive, also described herein as a "first diesel boiling hydrocarbon stream" and a "second diesel boiling hydrocarbon stream." Diesel fuels typically boil in the range of about 180° C. to about 360° C.

The first diesel additive can be a low-sulfur, hydrotreated diesel additive, having no more than 30 wppm sulfur, for example no more than about 25 wppm, no more than about 20 wppm, no more than about 15 wppm, no more than about 10 wppm, or no more than about 5 wppm sulfur. In some embodiments, the first diesel additive can provide up to about 40 vol % of the total fuel composition, for example up to about 35 vol %, up to about 30 vol %, up to about 25 vol %, up to about 20 vol %, up to about 15 vol %, up to about 10 vol %, or up to about 5 vol %.

The second diesel additive can be a low-sulfur, hydrotreated diesel additive, having no more than 20 wppm sulfur, for example no more than about 15 wppm, no more than about 10 wppm, no more than about 5 wppm, no more than about 3 wppm, or no more than about 2 wppm sulfur. In some embodiments, the second diesel additive can provide up to about 50 vol % of the total fuel composition, for example up to about 45 vol %, up to about 40 vol %, up to about 35 vol %, up to about 30 vol %, up to about 25 vol %, up to about 20 vol %, up to about 15 vol %, up to about 10 vol %, or up to about 5 vol %.

Blending to Form Marine Fuel Oil and/or Marine Distillate Fuel

Tools and processes for blending fuel components are well known in the art. See, for example, U.S. Pat. Nos. 3,522,169, 4,601,303, 4,677,567. Once a distillate fraction having 0.40 wt % or more of sulfur has been formed and/or once a marine fuel oil composition or marine distillate fuel composition has been formed, such fractions or compositions can be blended as desired with any of a variety of additives including (e.g.) viscosity modifiers, pour point depressants, lubricity modifiers, antioxidants, and combinations thereof.

Examples of Blend Components

Table 1 shows properties for a hydrotreated resid fraction that was used in forming examples of marine fuel oils. The hydrotreated resid in Table 1 has a sulfur content between 0.1 wt % and 0.5 wt %, a kinematic viscosity at 50° C. of more than 500 cSt, a pour point of 20° C. or more, a BMCI value of roughly 50, and an asphaltene content of 0.8 wt % or more.

TABLE 1

| Hydrotreated Resid | | |
|---|---|---|
| Properties | Method | |
| Density at 15° C. (kg/m$^3$) | ISO 12185 | 946.6 |
| CCAI | ISO-FDIS 8217 | 804.1 |
| Sulfur (wppm) | ISO 8754 | 3250 |
| Kinematic Viscosity @50° C. (cSt) | ISO 3104 | 537.2 |
| Flash point (° C.) | ISO 2719 A | >130.0 |
| Acid number (mg KOH/g) | ISO 6618 | 0.08 |
| Total sediment (wt %) | ISO 10307-2 | 0.01 |
| Carbon residue (wt %) | ISO 10370 | 5.31 |
| Pour point (° C.) | ISO 3016 | 27 |
| Water (vol %) | ISO 3733 | 0.00 |
| Ash (wt %) | ISO 2645 | 0.0112 |
| Asphaltene content (wt %) | D6560 | 0.88 |
| BMCI* | Calculated | 49.7 |
| Al + Si content (mg/kg) | IP501 | 5 |
| Ca content (mg/kg) | IP501 | 3 |
| Na content (mg/kg) | IP501 | 3 |
| Ni content (mg/kg) | IP501 | 4 |
| Zn content (mg/kg) | IP501 | <1 |
| V content (mg/kg) | IP501 | 6 |

*calculated using density and KV @50° C.

Table 2 shows properties for a hydrotreated distillate fraction that was used in forming examples of marine fuel oils and marine distillate fuels (also referred to as marine gas oils). The hydrotreated distillate in Table 2 has a sulfur content of less than 100 wppm, and corresponds to a potential ultra low sulfur diesel for use in passenger vehicles. The hydrotreated distillate in Table 2 also has a kinematic viscosity at 50° C. of roughly 2.0 cSt, a pour point of roughly −20° C., a cetane index of 52.0 or less, a density at 15° C. of 830 kg/m$^3$ or less, a T10 distillation point of 200° C. or less, a T50 distillation point of 260° C. or less, an aromatics content of 30 wt % or less, a combined naphthenes and aromatics content of less than 70 wt %, and a combined multi-ring naphthenes and multi-ring aromatics content of 25 wt % or less. It is noted that naphthenoaromatics are included as part of the aromatics content in Table 2. The reference to a "1.5 Ring" aromatic content refers to a compound including one aromatic ring and one naphthenic ring. Less than fully aromatic rings are counted as only 0.5 of a ring structure for purposes of the aromatic ring classes in Table 2 and Table 3.

TABLE 2

| Low Sulfur Distillate Fraction (Diesel 1) | | |
|---|---|---|
| Properties | Method | |
| Density at 60° F./15.6° C. (kg/m$^3$) | D4052 | 826.0 |
| Pour point (° C.) | D5950 | −19 |
| Cloud point (° C.) | D2500 | −10 |
| CFPP (° C.) | D6371 | −13 |
| Sulfur (wppm) | D2622 | 8 |
| Kinematic Viscosity @40° C. (cSt) | D445 | 2.113 |
| Flash point (° C.) | D93 | 55.0 |
| Rapid Small Scale Oxidation (min) | D7545 | 92.0 |
| Initial boiling point (° C.) | D86 | 170.1 |
| Boiling point 10% recov. (° C.) | D86 | 197.2 |
| Average boiling point (50% recov., ° C.) | D86 | 250.0 |
| Boiling point 90% recov. (° C.) | D86 | 312.9 |
| Final boiling point (° C.) | D86 | 347.0 |
| Calculated Cetane Index | D4737-A | 51.5 |
| Parafin content (wt %) | 2D-GC | 34.83 |
| 1 Ring naphthene content (wt %) | 2D-GC | 29.16 |
| 2 Ring naphthene content (wt %) | 2D-GC | 6.64 |
| Total aromatic content (wt %) | 2D-GC | 29.36 |
| 1 Ring aromatic content (wt %) | 2D-GC | 14.64 |
| 1.5 Ring aromatic content (wt %) | 2D-GC | 8.87 |

TABLE 2-continued

| Low Sulfur Distillate Fraction (Diesel 1) | | |
|---|---|---|
| Properties | Method | |
| 2+ Ring aromatic content (wt %) | 2D-GC | 5.85 |
| 3+ Ring aromatic content (wt %) | 2D-GC | 0.14 |

Table 3 shows properties for a hydrotreated distillate fraction that was used in forming examples of marine fuel oils and marine distillate fuels (also referred to as marine gas oils). The hydrotreated distillate in Table 3 has a sulfur content of roughly 0.6 wt %. The hydrotreated distillate in Table 3 also has a kinematic viscosity at 50° C. of 8.0 cSt or less, a pour point of −10° C. or less, a cetane index of 56.0 or more, a density at 15° C. of 860 kg/m$^3$ or more, a T10 distillation point of 280° C. or more, a T50 distillation point of 300° C. or more, an aromatics content of 35 wt % or more, a combined naphthenes and aromatics content of 75 wt % or more, and a combined multi-ring naphthenes and multi-ring aromatics content of 40 wt % or more. It is noted that naphthenoaromatics are included as part of the aromatics content in Table 3. The reference to a "1.5 Ring" aromatic content refers to a compound including one aromatic ring and one naphthenic ring. Less than fully aromatic rings are counted as only 0.5 of a ring structure for purposes of the aromatic ring classes in Table 2 and Table 3.

TABLE 3

| Distillate Fraction (Diesel 2) Including 0.55 wt % or more of Sulfur | | |
|---|---|---|
| Properties | Method | |
| Density at 60° F./15.6° C. (kg/m$^3$) | D4052 | 863.4 |
| Pour point (° C.) | D5950 | −11.4 |
| Cloud point (° C.) | D2500 | 7 |
| CFPP (° C.) | D6371 | 4 |
| Sulfur (wppm) | D2622 | 5900 |
| Kinematic Viscosity @40° C. (cSt) | D445 | 5.530 |
| Flash point (° C.) | D93 | 122.0 |
| Rapid Small Scale Oxidation (min) | D7545 | 1154.0 |
| Initial boiling point (° C.) | D86 | 259.9 |
| Boiling point 10% recov. (° C.) | D86 | 284.6 |
| Average boiling point (50% recov., ° C.) | D86 | 318.4 |
| Boiling point 90% recov. (° C.) | D86 | 349.2 |
| Final boiling point (° C.) | D86 | 365.2 |
| Calculated Cetane Index | D4737-A | 56.5 |
| Parafin content (wt %) | 2D-GC | 23.27 |

TABLE 3-continued

| Distillate Fraction (Diesel 2) Including 0.55 wt % or more of Sulfur | | |
|---|---|---|
| Properties | Method | |
| 1 Ring naphthene content (wt %) | 2D-GC | 29.32 |
| 2 Ring naphthene content (wt %) | 2D-GC | 9.56 |
| Total aromatic content (wt %) | 2D-GC | 37.85 |
| 1 Ring aromatic content (wt %) | 2D-GC | 10.14 |
| 1.5 Ring aromatic content (wt %) | 2D-GC | 8.50 |
| 2+ Ring aromatic content (wt %) | 2D-GC | 19.21 |
| 3+ Ring aromatic content (wt %) | 2D-GC | 4.18 |

Examples of Blends to Form Marine Fuel Oils

A series of four marine fuel oils were formed by blending the hydrotreated resid shown in Table 1 with Diesel 1 and/or Diesel 2 as shown in Table 2 or Table 3, respectively. Table 4 shows the percentages used of the hydrotreated resid, Diesel 1, and Diesel 2, in each of the marine fuel oil blends.

TABLE 4

| % Mass of Blend Components | | | |
|---|---|---|---|
| Blend | Diesel 1 | Diesel 2 | Hydrotreated Resid |
| 1 | 0.000 | 0.729 | 0.271 |
| 2 | 0.000 | 0.488 | 0.512 |
| 3 | 0.057 | 0.104 | 0.839 |
| 4 | 0.500 | 0.000 | 0.500 |

In Table 4, Blend 1 corresponds to a blend designed to have a sulfur content near the low sulfur fuel oil specification of 0.5 wt %. Blend 2 corresponds to a roughly 50/50 wt % blend of a distillate fraction having 0.40 wt % or more of sulfur with a hydrotreated resid fraction. Blend 4 provides a similar type of 50/50 wt % blend, but using a low sulfur diesel as the distillate fraction. Blend 3 corresponds to a blend that includes minor amounts of both low sulfur diesel (Diesel 1) and distillate with 0.40 wt % or more of sulfur (Diesel 2).

Table 5 shows various properties of Blends 1-4 from Table 4. The marine fuel oils shown in Table 4 have sulfur contents between around 0.1 wt % to 0.54 wt % with ranges of KV50s and densities varying from roughly 8 cSt to ~110 cSt and roughly 880 kg/m$^3$ to 930 kg/m$^3$, respectively.

TABLE 5

| Properties of Blends 1-4 | | | | | |
|---|---|---|---|---|---|
| Properties | Method | 1 | 2 | 3 | 4 |
| Density at 15° C. (kg/m$^3$) | ISO 12185 | 882.3 | 910.8 | 929.6 | 881.0 |
| CCAI | ISO-FDIS 8217 | 804.6 | 803.1 | 804.7 | 802.2 |
| Sulfur (wppm) | ISO 8754 | 5340 | 4400 | 3480 | 1570 |
| Kinematic Viscosity @50° C. (cSt) | ISO 3104 | 8.021 | 34.34 | 110.6 | 8.384 |
| Flash point (° C.) | ISO 2719 A | 125 | >130 | >130 | 65.0 |
| Acid number (mg KOH/g) | ISO 6618 | 0.07 | 0.08 | 0.05 | 0.05 |
| Total sediment (wt %) | ISO 10307-1 | 0.03 | 0.02 | 0.01 | 0.02 |
| Carbon residue, 10% Btm (wt %) | ISO 10370 | 1.0 | 3.2 | 4.6 | 2.6 |
| Pour point (° C.) | ISO 3016 | 3 | 3 | 6 | −18 |
| Water (vol %) | ISO 3733 | 0.00 | 0.00 | 0.00 | 0.00 |
| Ash (wt %) | ISO 6245 | 0.0019 | <0.001 | 0.0015 | 0.0030 |
| Initial boiling point (° C.) | D7169 | 99.3 | 86.3 | 177.5 | 110.1 |

TABLE 5-continued

| Properties of Blends 1-4 | | | | | |
|---|---|---|---|---|---|
| Properties | Method | 1 | 2 | 3 | 4 |
| Average boiling point (50% recov., ° C.) | D7169 | 344.4 | 398.9 | 513.6 | 370.2 |
| Final boiling point (° C.) | D7169 | 722.3 | 720.1 | 720.1 | 720.4 |
| BMCI* | Calculated | 40.3 | 47.4 | 45.8 | 36.5 |

*calculated using density and D7169 distillation data

When the hydrotreated resid was blended at about a 1:1 ratio with a distillate fraction, as shown in Blends 2 and 4 the combination of hydrotreated resid and higher sulfur distillate (Blend 2) had a higher BMCI value than the combination of hydrotreated resid and low sulfur distillate (Blend 4). This is believed to indicate the potential for Blend 2 to have better compatibility with asphaltene-containing marine fuels. The improved BMCI values for blends made using Diesel 2 are thought to be indicative of the higher total aromatic content and specifically higher multi-ring aromatic content in Diesel 2.

As shown in Table 5, certain properties of the diesels such as pour point can dominate when blended with the hydrotreated resid. This can result in a fuel oil blend with overall improved properties. For example, Blends 1 through 3 contain between about 15 to 70 mass % Diesel 1 or Diesel 2 which have a pour point of about −19° C. and −11° C., respectively. The balance of Blends 1-3 corresponds to the hydrotreated resid (pour point 27° C.). The pour point of blends 1 through 3 is 3-6° C., a significant improvement compared to the neat hydroreated resid. Blend 4 of Table 2 is a 1:1 mixture of Diesel 1 (pour point: −19° C.) and hydrotreated resid (pour point: 27° C.). Blend 4 has a pour point of −18° C.

Examples of Blends to Form Marine Distillate Fuels

Table 6 shows volume percentages for two distillate fuel blends (Blend 5 and Blend 6) that include a combination of Diesel 1 (from Table 2) and Diesel 2 (from Table 3). Blend 5 corresponds to a blend that includes a major portion of a distillate fraction with a sulfur content of 0.40 wt % or more. Blend 6 includes a major portion of a conventional low sulfur distillate fraction with a minor portion of the distillate fraction having a sulfur content of 0.40 wt % or more.

TABLE 6

| % Vol of Distillate Blend Components | | |
|---|---|---|
| Blend | Diesel (1) | Diesel (2) |
| Distillate Blend 5 | 0.26 | 0.74 |
| Distillate Blend 6 | 0.66 | 0.34 |

Table 7 shows various properties for Blend 5 and Blend 6. It is noted that the Diesel 1 blend component has a flash point that is too low to be suitable for use as a marine gas oil (i.e., marine distillate fuel). Blending in a minor portion of a higher flash point distillate fraction, as shown in Blend 6, can provide a marine distillate fuel with a relatively low sulfur content while also satisfying other specifications such as flash point. Additionally or alternately, adding the distillate fraction with a higher sulfur content also produces marine distillate fuels with a higher viscosity and/or a higher cetane index than the low sulfur Diesel 1 blendstock.

TABLE 7

| Distillate Blends 5 and 6 | | | |
|---|---|---|---|
| Properties | Method | Blend 5 | Blend 6 |
| Sulfur (wppm) | ISO 8754 | 4500 | 2080 |
| Kinematic Viscosity @40° C. (cSt) | ISO 3104 | 4.15 | 2.782 |
| Density at 15° C. (kg/m$^3$) | ISO 12185 | 854.0 | 838.8 |
| Calculated Cetane Index | ISO 4264 | 54.1 | 52.6 |
| Flash point (° C.) | ISO 2719 A | 83 | 69 |
| Acid number (mg KOH/g) | D664 | <0.1 | <0.1 |
| $H_2S$ Content, ppm | IP 570 | <0.4 | <0.4 |
| Total sediment (wt %) | ISO 10307-1 | <0.01 | <0.01 |
| Carbon residue (wt %) 10% Btm | ISO 10370 | <0.10 | <0.1 |
| Pour point (° C.) | ISO 3016 | 0 | −12 |
| Pour point (° C.) | D5950 | 3 | na |
| Pour point (° C.) w/ R223 (100 ppm) | D5950 | −6 | na |
| Pour point (° C.) w/ R223 (300 ppm) | D5950 | −21 | na |
| Cloud point (° C.) | EN 23015 | 3 | −3 |
| Water (vol %) | ISO 3733 | 0.00 | 0.00 |
| Ash (wt %) | ISO 6245 | 0.0049 | 0.0015 |
| Lubricity, Major Axis, μm | ISO 12156 | 422.00 | 345.00 |
| Lubricity, Minor Axis, μm | | 236.00 | 267.00 |
| Uncorrected Mean Wear Scan Diameter @60° C., μm | | 329.00 | 306.00 |

Comparative Example—Blends of Low Sulfur Distillate with High Sulfur Resid

Table 8 shows properties for two types of marine fuel oils that are believed to be representative of commercially available fuel oils. The first column in Table 8 corresponds to a fuel oil with a sulfur content of roughly 1 wt %. The second column in Table 8 corresponds to a fuel oil with a sulfur content of roughly 3.5 wt %, and corresponds to an RMG380 grade marine fuel oil. These fuel oils represent fuel oils formed from non-hydrotreated and/or less severely hydrotreated resid fractions.

TABLE 8

| Fuel Oils | | | |
|---|---|---|---|
| Properties | Method | 1% S FO | 3.5% S FO |
| Density at 15° C. (kg/m$^3$) | ISO 12185 | 0.9852 | 0.9908 |
| CCAI | ISO-FDIS 8217 | 848 | 854 |
| Sulfur (wppm) | ISO 8754 | 8200 | 34700 |
| Kinematic Viscosity @50° C. (cSt) | ISO 3104 | 318.5 | 305.7 |
| Flash point (° C.) | ISO 2719 A | 129 | 90 |
| Acid number (mg KOH/g) | ISO 6618 | 0.25 | 0.2 |
| Total sediment (wt %) | ISO 10307-2 | <0.01 | 0.02 |
| Micro carbon residue (wt %) | ISO 10370 | 10.32 | 10.97 |
| Pour point (° C.) | ISO 3016 | 9 | −3 |
| Water (vol %) | ISO 3733 | 0.05 | 0.1 |
| Ash (wt %) | ISO 2645 | <0.001 | 0.018 |
| Toluene Equivalence Point (TE) | | 11.5 | 30 |

TABLE 8-continued

| Fuel Oils | | | |
|---|---|---|---|
| Properties | Method | 1% S FO | 3.5% S FO |
| BMCI* | Calculated | 73 | 75.7 |
| BMCI − TE | | 62 | 46 |

*calculated using density and KV @50° C.

The Toluene Equivalence Point referred to in Table 8 corresponds to the toluene equivalence value (TE) as determined according to the toluene equivalence test described in U.S. Pat. No. 5,871,634. The content of U.S. Pat. No. 5,871,634 is incorporated herein by reference for the limited purpose of providing the definition for toluene equivalence (TE), solubility number ($S_{BN}$), and insolubility number ($I_N$).

A blending model based on empirical data was used to simulate the blending of the fuel oils in Table 8 with Diesel 1 from Table 4 in order to make low sulfur fuel oil blends having a sulfur content of 0.5 wt % or less (5000 wppm or less). In order to meet this sulfur target using a conventional strategy of combining a high sulfur resid/fuel oil fraction with a low sulfur diesel/distillate fraction, substantial amounts of Diesel 1 were included in both blends. The resulting blends are shown as Blend 7 and Blend 8 in Table 9. Blend 7 corresponds to 55 wt % of the 1 wt % sulfur fuel oil from Table 8 and 45 wt % of Diesel 1. Blend 8 corresponds to 12 wt % of the 3.5 wt % sulfur fuel oil from Table 8 and 88 wt % of Diesel 1.

| Properties | Blend 7 | Blend 8 |
|---|---|---|
| Density at 15° C. (kg/m$^3$) | 0.9173 | 0.8461 |
| CCAI | 826 | 805 |
| Sulfur (wppm) | 4866 | 4883 |
| Kinematic Viscosity at 50° C. (cSt) | 12.5 | 2.5 |
| Toluene Equivalence Point (TE) | 12 | 30 |
| BMCI | 53 | 34 |
| BMCI − TE | 41 | 4 |
| Micro carbon residue (wt %) | 6.1 | 1.5 |

It is noted that Blend 7 has a higher carbon residue content (greater than 5.0 wt %) than the marine fuel oil blends shown in Table 5. Due to the high amount of diesel that was required to achieve a 0.5 wt % sulfur content in Blend 8, the resulting kinematic viscosity is low for a marine fuel oil. Additionally, the low BMCI value and/or the low value for BMCI-TE indicate a fuel oil that has an increased likelihood of having compatibility problems when blended with other fuel oil and/or distillate fractions.

ADDITIONAL EMBODIMENTS

Additionally or alternately, the present invention can include one or more of the following embodiments.

Embodiment 1

A method for forming a fuel oil composition, comprising: blending a first distillate fraction comprising a T90 distillation point of 400° C. or less, a sulfur content of 0.40 wt % or more, and an aromatics content greater than 35 wt % relative to a weight of the first distillate fraction, with a resid fraction having a T90 distillation point of 500° C. or more and a sulfur content of 0.35 wt % or less relative to a weight of the resid fraction, to form a fuel oil composition comprising a sulfur content of 0.1 wt % to 0.6 wt % relative to a weight of the fuel oil composition, the fuel oil composition comprising at least 5 wt % of the first distillate fraction and at least 15 wt % of the resid fraction.

Embodiment 2

The method of Embodiment 1, wherein the first distillate fraction comprises a hydrotreated distillate fraction, or wherein the resid fraction comprises a hydrotreated resid fraction, or a combination thereof.

Embodiment 3

The method of any of the above embodiments, wherein the fuel oil composition comprises a BMCI of 40.0 or more, or 42.0 or more, or 44.0 or more; or wherein the fuel oil composition comprises a kinematic viscosity at 50° C. of at least 5 cSt, or at least 15 cSt, or 15 cSt to 300 cSt, or 15 cSt to 150 cSt; or wherein the fuel oil composition comprises a micro carbon residue content of 5.0 wt % or less, or 4.0 wt % or less; or a combination thereof.

Embodiment 4

The method of any of the above embodiments, wherein the first distillate fraction comprises a T50 distillation point of 300° C. or more, or 320° C. or more; or wherein the resid fraction comprises a T50 distillation point of 340° C. or more; or a combination thereof.

Embodiment 5

The method of any of the above embodiments, wherein the blending further comprises blending a second hydrotreated distillate fraction having a sulfur content of 0.1 wt % or less with the first distillate fraction, the resid fraction, or the fuel oil composition, an amount of the second hydrotreated distillate fraction in the fuel oil composition comprising less than half the amount of the first distillate fraction in the fuel oil composition.

Embodiment 6

The method of any of the above embodiments, wherein the fuel oil composition comprises at least 25 wt % of the resid fraction, or at least 45 wt %.

Embodiment 7

A method for forming a gas oil composition, comprising: blending a first distillate fraction comprising a T90 distillation point of 400° C. or less, a sulfur content of 0.40 wt % or more, and an aromatics content greater than 35 wt % relative to a weight of the first distillate fraction, with a second distillate fraction having a sulfur content of 0.1 wt % or less relative to a weight of the second distillate fraction, to form a gas oil composition comprising a sulfur content of 0.1 wt % to 0.6 wt % relative to a weight of the gas oil composition, the gas oil composition comprising at least 10 wt % of the first distillate fraction and at least 10 wt % of the second distillate fraction, wherein the first distillate fraction comprises greater than 35 wt % aromatics relative to a weight of the first distillate fraction.

Embodiment 8

The method of Embodiment 7, wherein the first distillate fraction comprises a hydrotreated distillate fraction, or wherein the second distillate fraction comprises a hydrotreated distillate fraction, or a combination thereof.

Embodiment 9

The method of Embodiment 7 or 8, wherein the first distillate fraction comprises a T50 distillation point of 300° C. or more, or 320° C. or more; or wherein the second distillate fraction comprises a T50 distillation point of 280° C. or less, or 260° C. or less; or a combination thereof.

Embodiment 10

The method of any of Embodiments 7 to 9, wherein the gas oil composition comprises a flash point of 60° C. or more, and wherein the second distillate fraction comprises a flash point of less than 60° C.

Embodiment 11

The method of any of Embodiments 7 to 10, wherein the gas oil composition comprises a kinematic viscosity at 40° C. of 2.5 cSt or more, or 4.0 cSt or more; or to wherein the gas oil composition comprises a cetane index of 50.0 or more, or 52.0 or more, or 54.0 or more; or a combination thereof.

Embodiment 12

The method of any of the above embodiments, wherein the first distillate fraction comprises a combined content of aromatics and naphthenes of 60 wt % or more (or 65 wt % or more, or 70 wt % or more); or wherein the first distillate fraction comprises 38 wt % or more aromatics (or 40 wt % or more); or a combination thereof.

Embodiment 13

The method of any of the above embodiments, further comprising hydrotreating a feed comprising a distillate portion to form an effluent comprising the first distillate fraction, the feed (or the distillate portion of the feed) comprising an aromatics content of 50 wt % or more, or 60 wt % or more.

Embodiment 14

A distillate composition comprising a T90 distillation point of 400° C. or less, a T50 distillation point of 300° C. or more, a cetane index of 50 or more, a sulfur content of 0.35 wt % or more (or 0.40 wt % or more), an aromatics content of greater than 35 wt %, and a combined content of aromatics and naphthenes of 60 wt % or more relative to a weight of the composition, the composition optionally comprising a flash point of 100° C. or more, the composition optionally comprising a cloud point of 0° C. or less, the composition optionally further comprising one or more additives.

Embodiment 15

A composition made according to the method of any of Embodiments 1-13.

Additional Embodiment A

The composition of Embodiment 15, further comprising one or more additives.

The above examples are strictly exemplary, and should not be construed to limit the scope or understanding of the present invention. It should be understood by those skilled in the art that various changes may be made and equivalents may be substituted without departing from the true spirit and scope of the Invention. In addition, many modifications may be made to adapt a particular situation, material, composition of matter, process, process step or steps, to the objective, spirit and scope of the described invention. All such modifications are intended to be within the scope of the claims appended hereto. It must also be noted that as used herein and in the appended claims, the singular forms "a," "an," and "the" include plural referents unless the context clearly dictates otherwise. Each technical and scientific term used herein has the same meaning each time it is used. The use of "or" in a listing of two or more items indicates that any combination of the items is contemplated, for example, "A or B" indicates that A alone, B alone, or both A and B are intended. The publications discussed herein are provided solely for their disclosure prior to the filing date of the present application. Nothing herein is to be construed as an admission that the described invention is not entitled to antedate such publication by virtue of prior invention. Further, the dates of publication provided may be different from the actual publication dates which may need to be confirmed independently.

The invention claimed is:

1. A method for forming a fuel oil composition, comprising:

blending a first hydrotreated distillate fraction comprising a kinematic viscosity at 50° C. of 8.0 cSt or less, a T90 distillation point of 400° C. or less, a sulfur content of 0.40 wt % or more, and an aromatics content of greater than 35 wt % relative to a weight of the first hydrotreated distillate fraction, with a hydrotreated resid fraction having a T90 distillation point of 500° C. or more and a sulfur content of 0.35 wt % or less relative to a weight of the hydrotreated resid fraction, to form a fuel oil composition comprising a sulfur content of 0.1 wt % to 0.6 wt % relative to a weight of the fuel oil composition, the fuel oil composition comprising at least 5 wt % of the first hydrotreated distillate fraction and at least 15 wt % of the hydrotreated resid fraction.

2. The method of claim 1, wherein the first hydrotreated distillate fraction comprises a combined content of aromatics and naphthenes of 60 wt % or more.

3. The method of claim 1, wherein the fuel oil composition comprises a BMCI of 40.0 or more, a micro carbon residue content of 5.0 wt % or less, or a combination thereof.

4. The method of claim 1, wherein the hydrotreated resid fraction comprises a T50 distillation point of 340° C. or more.

5. The method of claim 1, wherein the first hydrotreated distillate fraction comprises 38 wt % or more aromatics.

6. The method of claim 1, wherein the fuel oil composition comprises a kinematic viscosity at 50° C. of at least 5 cSt.

7. The method of claim 1, wherein the fuel oil composition comprises a kinematic viscosity at 50° C. of 15 cSt to 300 cSt.

8. The method of claim 1, further comprising hydrotreating a feed comprising a distillate portion to form an effluent comprising the first hydrotreated distillate fraction, the feed (or the distillate portion of the feed) comprising an aromatics content of 50 wt % or more.

9. The method of claim 1, wherein the blending further comprises blending a second hydrotreated distillate fraction having a sulfur content of 0.1 wt % or less with the first hydrotreated distillate fraction, the hydrotreated resid fraction, or the fuel oil composition, an amount of the second hydrotreated distillate fraction in the fuel oil composition comprising less than half the amount of the first hydrotreated distillate fraction in the fuel oil composition.

10. The method of claim 1, wherein the fuel oil composition comprises at least 25 wt % of the hydrotreated resid fraction.

11. A method for forming a gas oil composition, comprising:

blending a first hydrotreated distillate fraction comprising a kinematic viscosity at 50° C. of 8.0 cSt or less, a T90 distillation point of 400° C. or less and a sulfur content of 0.40 wt % or more relative to a weight of the first hydrotreated distillate fraction, with a second hydrotreated distillate fraction having a sulfur content of 0.1 wt % or less relative to a weight of the second hydrotreated distillate fraction, to form a gas oil composition comprising a sulfur content of 0.1 wt % to 0.6 wt % relative to a weight of the gas oil composition, the gas oil composition comprising at least 10 wt % of the first hydrotreated distillate fraction and at least 10 wt % of the second hydrotreated distillate fraction, wherein the first hydrotreated distillate fraction comprises greater than 35 wt % aromatics relative to a weight of the first hydrotreated distillate fraction.

12. The method of claim 11, wherein the first hydrotreated distillate fraction comprises a combined content of aromatics and naphthenes of 60 wt % or more.

13. The method of claim 11, wherein the first hydrotreated distillate fraction comprises a T50 distillation point of 300° C. or more; or wherein the second hydrotreated distillate fraction comprises a T50 distillation point of 280° C. or less; or a combination thereof.

14. The method of claim 11, wherein the first hydrotreated distillate fraction comprises 38 wt % or more aromatics.

15. The method of claim 11, wherein the gas oil composition comprises a flash point of 60° C. or more, and wherein the second hydrotreated distillate fraction comprises a flash point of less than 60° C.

16. The method of claim 11, wherein the gas oil composition comprises a kinematic viscosity at 40° C. of 2.5 cSt or more.

17. The method of claim 11, wherein the gas oil composition comprises a cetane index of 50.0 or more.

18. A hydrotreated distillate composition comprising a kinematic viscosity at 50° C. of 8.0 cSt or less, a T90 distillation point of 400° C. or less, a T50 distillation point of 300° C. or more, a cetane index of 50 or more, a sulfur content of 0.40 wt % or more, an aromatics content of greater than 35 wt %, and a combined content of aromatics and naphthenes of 60 wt % or more relative to a weight of the composition.

19. The composition of claim 18, wherein the composition comprises a flash point of 100° C. or more, a cloud point of 0° C. or less, or a combination thereof.

20. The composition of claim 18, further comprising one or more additives.

21. A fuel oil composition comprising:

at least 5 wt % of a first hydrotreated distillate fraction comprising a kinematic viscosity at 50° C. of 8.0 cSt or less, a T90 distillation point of 400° C. or less, a sulfur content of 0.40 wt % or more, and an aromatics content of greater than 35 wt % relative to a weight of the first hydrotreated distillate fraction;

at least 15 wt % of a hydrotreated resid fraction having a T90 distillation point of 500° C. or more and a sulfur content of 0.35 wt % or less relative to a weight of the hydrotreated resid fraction; and wherein the sulfur content of the fuel oil composition is from 0.1 wt % to 0.6 wt % relative to a weight of the fuel oil composition.

22. The composition of claim 21, wherein the first hydrotreated distillate fraction comprises a combined content of aromatics and naphthenes of 60 wt % or more.

23. The composition of claim 21, wherein the fuel oil composition comprises a kinematic viscosity at 50° C. of at least 5 cSt.

24. A gas oil composition, comprising:

at least 10 wt % of a first hydrotreated distillate fraction comprising a kinematic viscosity at 50° C. of 8.0 cSt or less, a T90 distillation point of 400° C. or less, a sulfur content of 0.40 wt % or more relative to a weight of the first hydrotreated distillate fraction, and greater than 35 wt % aromatics relative to a weight of the first hydrotreated distillate fraction;

at least 10 wt % of a second hydrotreated distillate fraction having a sulfur content of 0.1 wt % or less relative to a weight of the second hydrotreated distillate fraction; and wherein the sulfur content of the gas oil composition is from 0.1 wt % to 0.6 wt % relative to a weight of the gas oil composition.

25. The gas oil composition of claim 24, wherein the first hydrotreated distillate fraction comprises a combined content of aromatics and naphthenes of 60 wt % or more.

26. The gas oil composition of claim 24, wherein the first hydrotreated distillate fraction comprises a T50 distillation point of 300° C. or more; or wherein the second hydrotreated distillate fraction comprises a T50 distillation point of 280° C. or less; or a combination thereof.

* * * * *